US008650888B2

(12) United States Patent
Steinmeyer et al.

(10) Patent No.: US 8,650,888 B2
(45) Date of Patent: Feb. 18, 2014

(54) CURRENT LEAD QUENCHING ASSEMBLY

(75) Inventors: Florian Steinmeyer, Witney (GB); Keith White, Oxon (GB)

(73) Assignee: Siemens Plc, Frimley, Camberley, Surrey (GB)

( * ) Notice: Subject to any disclaimer, the term of this patent is extended or adjusted under 35 U.S.C. 154(b) by 1796 days.

(21) Appl. No.: 10/496,135

(22) PCT Filed: Nov. 20, 2002

(86) PCT No.: PCT/EP02/13319

§ 371 (c)(1),
(2), (4) Date: May 27, 2005

(87) PCT Pub. No.: WO03/044424

PCT Pub. Date: May 30, 2003

(65) Prior Publication Data

US 2005/0204751 A1 Sep. 22, 2005

(30) Foreign Application Priority Data

Nov. 21, 2001 (DE) ..... 101 57 105
Mar. 20, 2002 (GB) ..... 0206517.5

(51) Int. Cl.
*F25B 19/00* (2006.01)
*H01F 1/00* (2006.01)
*H01B 7/42* (2006.01)

(52) U.S. Cl.
USPC ..... 62/51.1; 335/216; 174/15.6; 505/163

(58) Field of Classification Search
USPC ..... 62/259.2, 51.1; 174/15.4–16.3, 125.1, 174/125.16; 335/216; 505/163
See application file for complete search history.

(56) References Cited

U.S. PATENT DOCUMENTS 3,371,145 A * 2/1968 Camille, Jr. ..... 174/15.4
4,223,540 A * 9/1980 Longsworth ..... 62/51.1

(Continued)

FOREIGN PATENT DOCUMENTS

EP 0 482 840 A1 4/1992
GB 2 155 244 A 9/1985
JP 06103846 A * 4/1994

OTHER PUBLICATIONS

Search Report in related UK Patent Application No. 0206517.5 dated Oct. 31, 2002.

*Primary Examiner* — John Pettitt
(74) *Attorney, Agent, or Firm* — Crowell & Moring LLP

(57) ABSTRACT

The present invention relates to a cryostat having a service neck for access to a superconducting magnet. In many cryogenic applications components, e.g. superconducting coils for magnetic resonance imaging (MRI), superconducting transformers, generators, electronics, are cooled by keeping them in contact with a volume of liquefied, the whole cryogenic assembly being known as a cryostat. In order to operate a superconducting magnet, it must be kept at a temperature below its superconducting transition temperature. A cryostat must provide access to the vessel containing the liquefied helium for the initial cooling of the magnet to its low operating temperature, for periodic refilling of systems where there is a loss of helium, and provide sufficient access whereby to enable operation and maintenance of the magnet. The present invention seeks to provide an access neck to a cryostat such as helium vessel with a minimum heat load and accordingly provides a cryostat assembly, wherein a service neck comprising at least one positive and one negative current lead is arranged such that one of the leads is formed by the neck tube wall and the space between a neck tube wall and the second current lead forms a gas path for venting and/or filling or other services.

11 Claims, 12 Drawing Sheets

(56) References Cited

U.S. PATENT DOCUMENTS

| | | | | | |
|---|---|---|---|---|---|
| 4,369,636 | A | | 1/1983 | Purcell et al. | |
| 4,394,634 | A | * | 7/1983 | Vansant | 335/216 |
| 4,411,138 | A | | 10/1983 | Leithauser et al. | |
| 4,600,802 | A | | 7/1986 | Ihas et al. | |
| 4,625,192 | A | * | 11/1986 | Kawaguchi | 335/216 |
| 4,695,675 | A | * | 9/1987 | Yamamoto | 174/15.4 |
| 4,841,268 | A | | 6/1989 | Burnett et al. | |
| 5,220,800 | A | * | 6/1993 | Muller et al. | 62/51.1 |
| 5,298,679 | A | | 3/1994 | Wu et al. | |
| 5,307,037 | A | | 4/1994 | Woods et al. | |
| 5,697,220 | A | | 12/1997 | Pierce et al. | |
| 7,140,190 | B2 | | 11/2006 | Daniels | |
| 7,475,552 | B2 | | 1/2009 | Sorsby | |

* cited by examiner

CURRENT LEAD QUENCHING ASSEMBLY

CROSS REFERENCE TO RELATED APPLICATIONS

This application is related to U.S. patent application Ser. No. 10/300,940 entitled "Cryostat".

FIELD OF THE INVENTION

The present invention relates to a cryogenic assembly. In particular, but not necessarily restricted thereto, the present invention relates to a cryostat having a service neck for access to a superconducting magnet.

BACKGROUND TO THE INVENTION

In many cryogenic applications components, e.g. superconducting coils for magnetic resonance imaging (MRI), superconducting transformers, generators, electronics, are cooled by keeping them in contact with a volume of liquefied gas (e.g. Helium, Neon, Nitrogen, Argon, Methane), the whole cryogenic assembly being known as a cryostat. In order to operate a superconducting magnet, it must be kept at a temperature below its superconducting transition temperature. For conventional low temperature superconductors, the transition temperature is in the region of 10K, and typically the magnet is cooled in a container or vessel comprising a bath of liquid helium, commonly called a helium vessel, at 4.2K. For simplicity, reference shall now be made to helium, but this does not preclude the use of other gases. Services need to be run from the external environment at room temperature into the helium vessel, for monitoring purposes and to energize the magnet. Any dissipation in the components or heat getting into the system causes helium boil-off. To account for such losses, replenishment is required. This service operation is considered as problematic by many users and great efforts have been made over the years to introduce refrigerators that either reduce the rate of boil-off, or recondense any lost liquid back into the bath.

In many cryostats the liquid gas boils away slowly as a result of heat entering the system. A suitable means must be available for the gas to exit from the cryostat, but it is one function of the cryostat to reduce this boiling to as low a value as practical since gases such as helium are expensive commodities. In other cryostats, a refrigerator is fitted, which recondenses the evaporated gases so that there is no overall loss of helium. In these cryostats, the heat load must be kept low enough that the refrigerator can perform the recondensation.

A cryostat must provide access to the vessel containing the liquified helium for the initial cooling of the magnet to its low operating temperature, and for periodic refilling of systems where there is a loss of helium. Furthermore, the cryostat must provide access to the helium vessel to measure the level of the liquified helium, and provide sufficient access whereby to enable operation and maintenance of the magnet. The magnet typically comprises one or more superconducting electromagnetic coils in series connection with a superconducting switch so that the field can be trapped in the magnet. Heat must be supplied to the superconducting switch to heat it above its superconducting transition temperature in order to "open" it. Electric current must be supplied to the magnet in order to energize it.

Electric current for the magnet is conveniently supplied through a removable current lead which is inserted through the access neck and provides electrical contact between an electrical terminal of a magnet at 4.2K and external cables at room temperature which connect to a power supply. Alternatively, a set of fixed current leads have been used which are permanently installed in the access neck so that the neck does not have to be opened to atmosphere in order to insert a removable current lead. Opening the neck tube to the atmosphere is to be avoided as there is the possibility of air entering the neck and helium vessel. This is to be avoided since air at temperatures below 0° C. (at normal atmospheric pressure) will include ice from water and, if present in the necks, would tend to collect at the bottom of the neck and either block the neck or prevent access to the magnet electrical terminal. Fixed current leads add to the heat load on the helium vessel.

Once the magnet has been energized, should an emergency situation arise which requires that the magnetic field be discharged rapidly, the magnet must be "quenched". This involves heating a section of the magnet above its critical temperature so that it becomes resistive. The heat generated in this resistive section heats the adjacent parts of the magnet and causes them to become resistive. In this way the whole magnet rapidly becomes resistive, and the magnetic field is rapidly reduced to a negligible amount. The energy stored in the magnet is released into the liquid helium with the subsequent evolution of a large quantity of gas. The gas flow in this process can be high, and the access neck must provide a path for the gas to escape from the helium vessel without causing an excessive pressure in the helium vessel. The above, and other services, are provided through the service neck.

An example of prior art, comprising a conventional access neck is shown in FIG. 1: a tube 10 connects the vacuum vessel 12 at room temperature with a helium vessel 14 at a superconducting temperature, e.g., 4.2K. A vacuum exists external to the tube 10; helium gas is present inside. A guide tube 16 provides a guide for a removable current lead (not shown) so that it engages on a magnet connector 18. The guide tube is fitted with one or more radiation baffles 20 to reduce the amount of thermal radiation passing from room temperature to the helium vessel. Thermal connections 24 external to the tube 10 are connected to a cooling device (not shown) to intercept conducted heat.

There are several disadvantages of such an access neck configuration. Firstly the neck must be opened in order to insert the removable current lead, with the possibility of admitting air to the helium vessel. Secondly, there is no means of providing a controlled de-energization of the magnet except by fitting the removable current lead, which means that a trained service engineer is required. Thirdly, the back pressure during a quench process is high because of the use of multiple radiation baffles. Furthermore the heat load at the magnet connector is typically high during energization of the magnet, leading to high helium loss. Additionally the thermal connections 24 connect only to the outside of the service neck tube 10 and as such are not ideal because of non-optimal thermal contact with the gas in the neck tube.

A further prior example is shown in FIG. 2. This alternative access neck contains fixed current leads 30, comprising tubes of a moderate thermal conductivity material such as brass so as to conduct little heat into the system whilst having convenient dimensions for carrying electric current. This design is well known to those skilled in the art. The leads are mechanically secured by at least one collar 24 which also provides a means of conducting heat from the tubes to a heat sink (not shown). Item 32 is a means of electrically isolating the one or more collars 24 from at least one of the conductor tubes 30 whilst providing good thermal contact between them. Fixed electrical contacts 34 provide a means of electrical connection for electrical cabling 36, 38 to the magnet which have low electrical resistance.

Some of the disadvantages of this access neck are that the back pressures developed during a quench process can be high; this is because the gas must be vented primarily up the fixed leads in order to ensure that they are adequately cooled during magnet energization. The cooling of the gas column is not particularly efficient because the boil-off gas passes primarily up the two fixed leads. The diameter of the leads cannot be made large because other service operations and fittings must also be provided through the neck and if the neck diameter is increased the heat load increases.

Furthermore, there are three paths for gas going up the neck, two inside the current leads and one through the surrounding space inside the neck wall. In order to achieve optimum cooling of the current leads during a magnet ramp, gases should pass through the leads only and not through the third path. However, to achieve minimum helium losses during normal standby operation, with no current flowing in the leads, it is preferable to have some of the boil-off gas going through the third path, cooling both the neck as well as the leads. These conflicting requirements lead to a higher boil-off of gases then is preferred. Balancing the three parallel gas streams in a neck assembly requires precise knowledge of the gas impedances which is hard to predict and even harder to control in taking manufacturing tolerances into account.

OBJECT OF THE INVENTION

The present invention seeks to provide an improved cryostat. In particular, the present invention seeks to provide an access neck to a cryostat such as helium vessel which provides the required services with a minimum heat load.

STATEMENT OF THE INVENTION

In accordance with a first aspect of the invention, there is provided a cryostat assembly operable to support electrical, electronic, or a magnetic device immersed in a cryogenic fluid, comprising a cryogenic fluid container, having a service neck operable to provide access from an ambient atmosphere to the cryogenic fluid container, wherein the service neck comprises at least one positive and one negative current lead, arranged such that one of the leads is formed by the neck tube wall and the space between the neck tube wall and the second current lead forms a gas path for venting and/or filling or other services.

There are several advantages arising from the invention: There is a reduced pressure difference in the neck, with an improved contact between components and cooling fluids; a lower heat load on the components is provided; there are provided separate paths for fluid release from the neck.

BRIEF DESCRIPTION OF THE FIGURES

The invention may be understood more readily, and various other aspects and features of the invention may become apparent from consideration of the following description and the figures as shown in the accompanying drawing sheets, wherein.

DETAILED DESCRIPTION OF THE INVENTION

There will now be described, by way of example, the best mode contemplated by the inventors for carrying out the invention. In the following description, numerous specific details are set out in order to provide a complete understanding of the present invention. It will be apparent, however, to those skilled in the art, that the present invention may be put into practice with variations of this specific.

Figure 3:
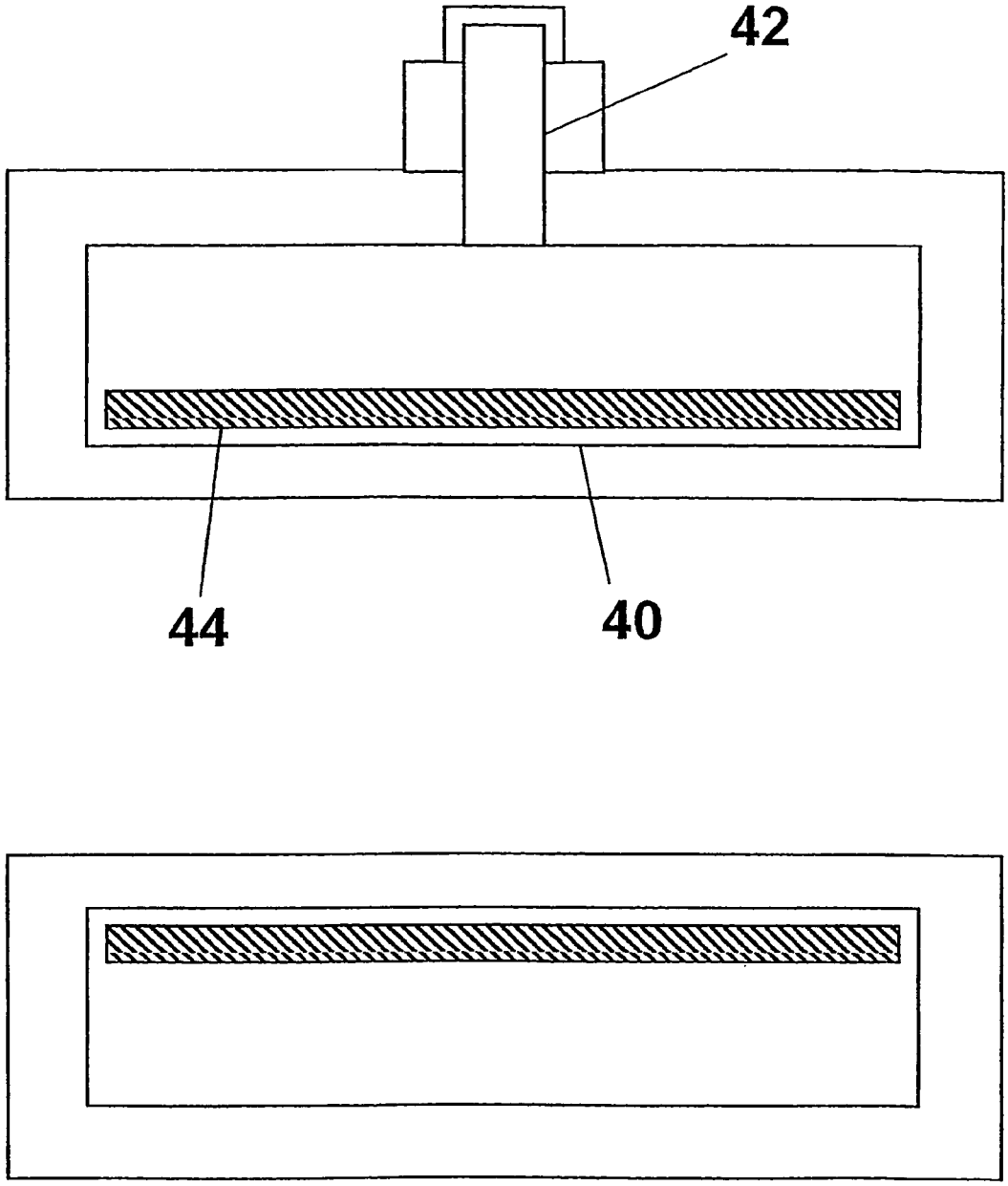
FIG. 3 shows a schematic view of a cryostat.

FIG. 3 shows a schematic representation of a cryostat for a whole body magnetic resonance imaging device which operates at superconducting temperatures. There is a liquid helium vessel 40 which encloses a superconducting magnet 44. A service neck 42 is provided to enable access to the magnet.

Figure 4:
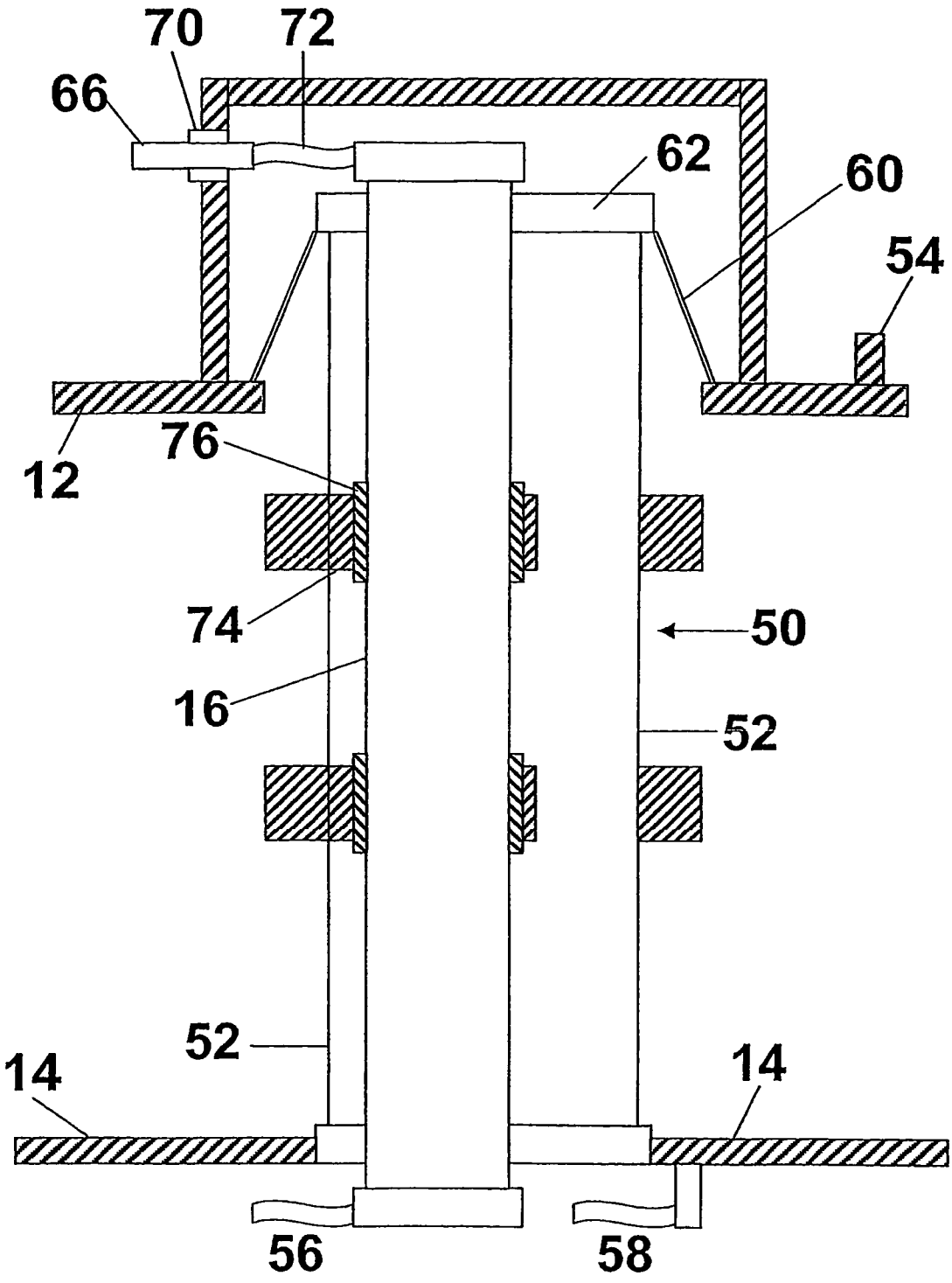
FIG. 4 shows a service neck of a cryostat in accordance with the invention.

Referring now to FIG. 4, there is shown a first embodiment of the invention. Service neck 50 is provided between the outer walls 12 of a cryostat and the walls 14 of a helium vessel. Electrical cabling wires 56 and 58 connect with the terminals of a magnet (not shown). Two distinct current paths are provided via the cryostat neck 50.

A first current path comprises external terminal 54, which is mounted on the cryostat wall 12, the cryostat wall supports 60, where connection is made to the outer service neck tube 52, which, in turn, is in electrical contact with the wall 14 of the helium vessel, which makes contact with cable 58.

a second current path comprises external terminal 66, mounted within an insulator 70 in the cryostat wall 12, a cable 72 which connects to the inner tube 16, which inner tube 16 extends within the helium vessel and makes contact with cable 56.

Thus electrical connection is enabled through the gas tight turret/cryostat wall. Current lead tubes 52 and 16 are preferably made from stainless steel or brass, but may be made of other suitably conducting materials, the means of determining specific dimensions being well known to those skilled in the art.

Collar 74, is preferably made of a high conductivity material, such as copper, which is used to mechanically support the inner tube 16 and to provide means of connecting both tubes to a heat sink (not shown) for the purpose of intercepting heat conducted from a higher temperature to a lower temperature along the tubes, the gas contained within the tubes, and any other heat conductor either within the confines of the outer tube 52 or elsewhere within the vacuum space. There may be one or more collars 74 depending on the construction of the cryostat and the number of heat sinks available. Insulator 76 provides electrical insulation between first and second current paths and thermal conduction to the collar 74. It maybe made of many types of material, but is conveniently made of one such as sapphire, aluminium oxide, or a ceramic where the high thermal conductivity characteristics are particularly good. The insulator 76 assists in the conduction of heat from the inner tube 16 and is of a size such that it can be bonded firmly to collar 74, for example by gluing or soldering.

Figure 5:
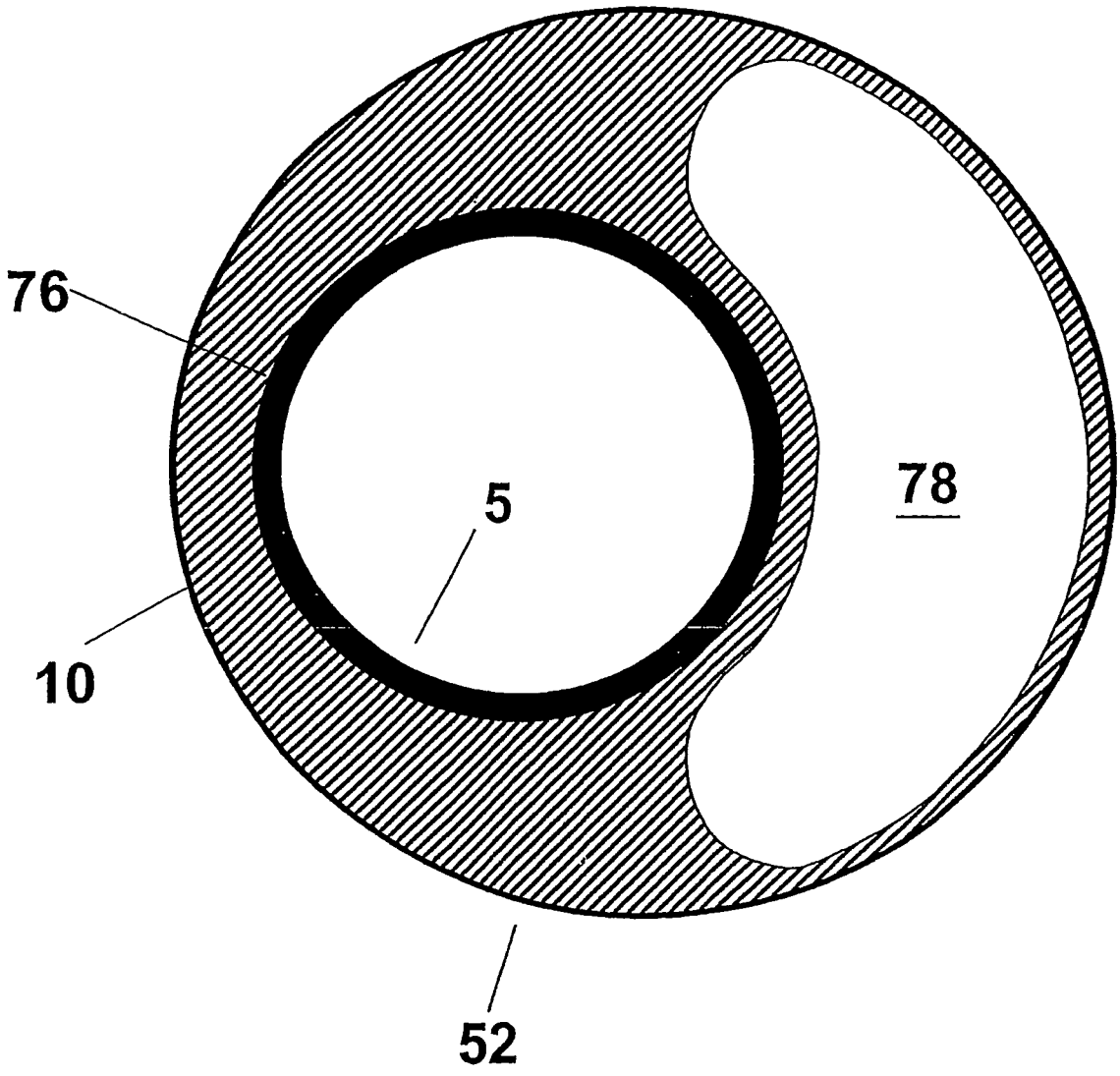
FIG. 5 shows a first collar.

FIG. 5 shows a section through collar 74 in a radial plane. An aperture is provided for the ring like insulator 76 and there is provided a further aperture 78 through which normal boil-off and quench gases pass from the helium vessel. The area of hole 78 is dimensioned to provide a low pressure drop with the expected mass flow during a quench, whilst at the same time restricting the amount of radiation which can pass from components at a higher temperature with respect to the helium vessel, into the helium vessel, thereby reducing the heat load on the helium vessel.

Figure 1:
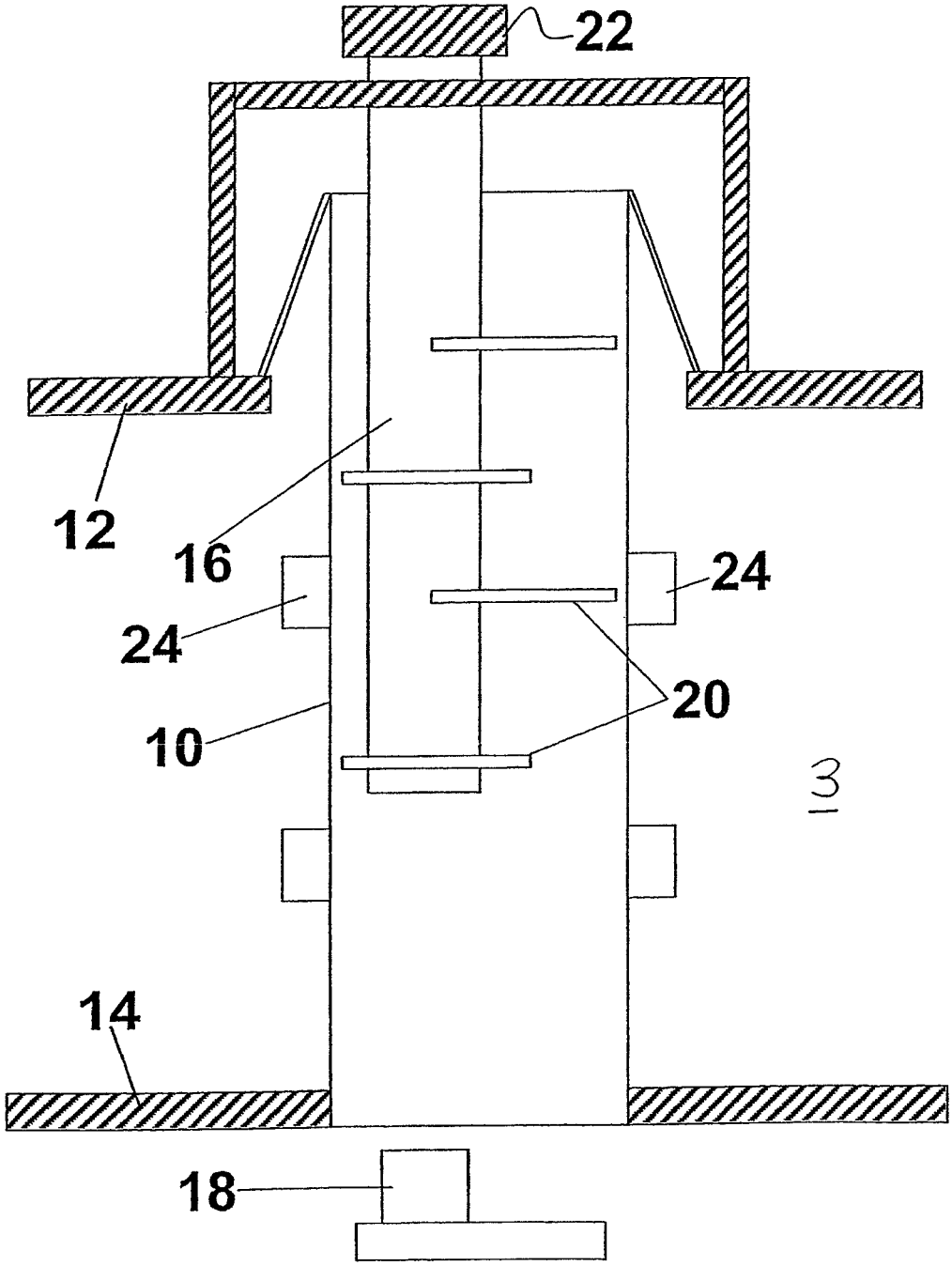
Figure 1 (Prior Art)
FIG. 1 shows a first example of a prior art cryostat.
Figure 2:
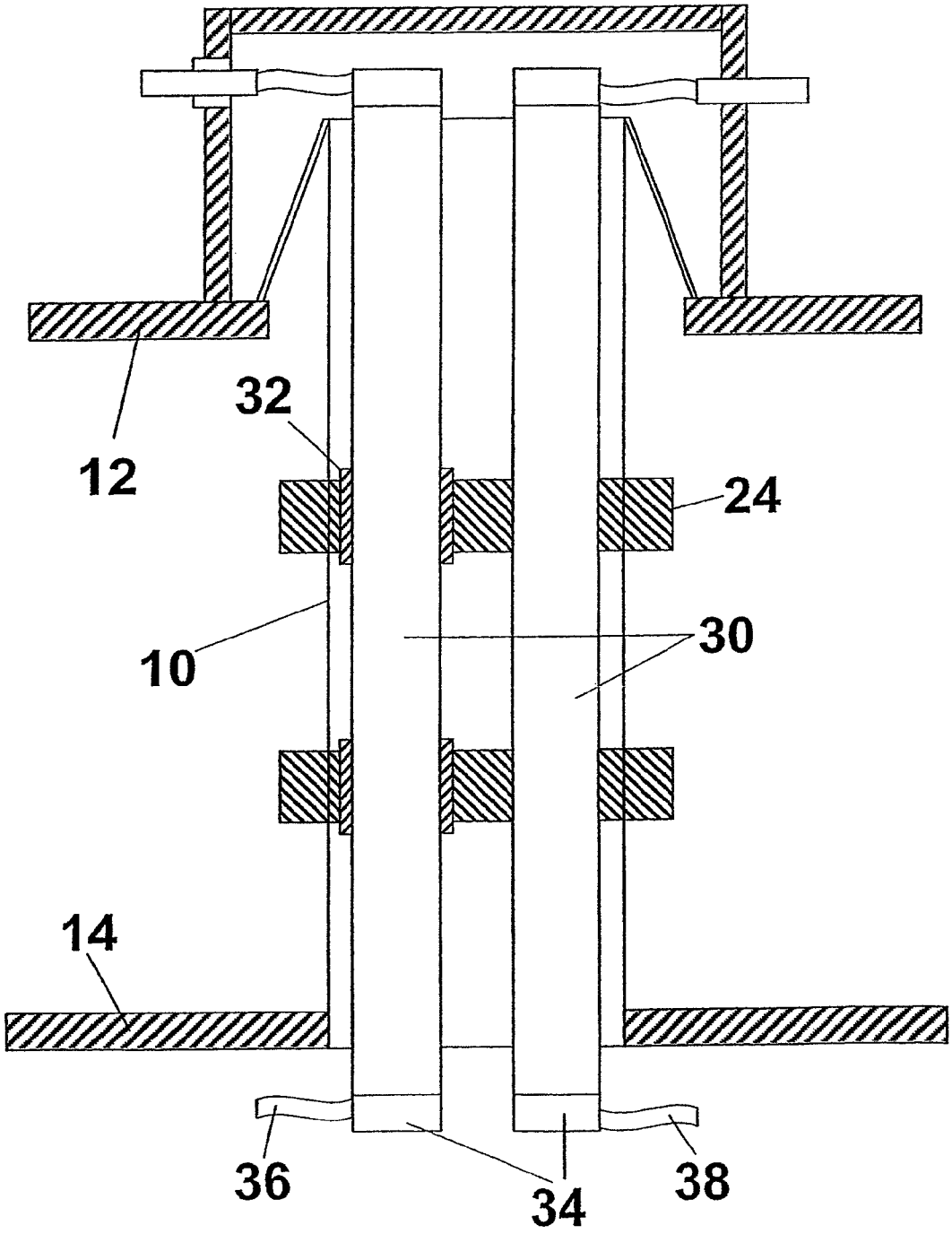
Figure 2 (Prior Art)
FIG. 2 shows a second example of a prior art cryostat.
Figure 6:
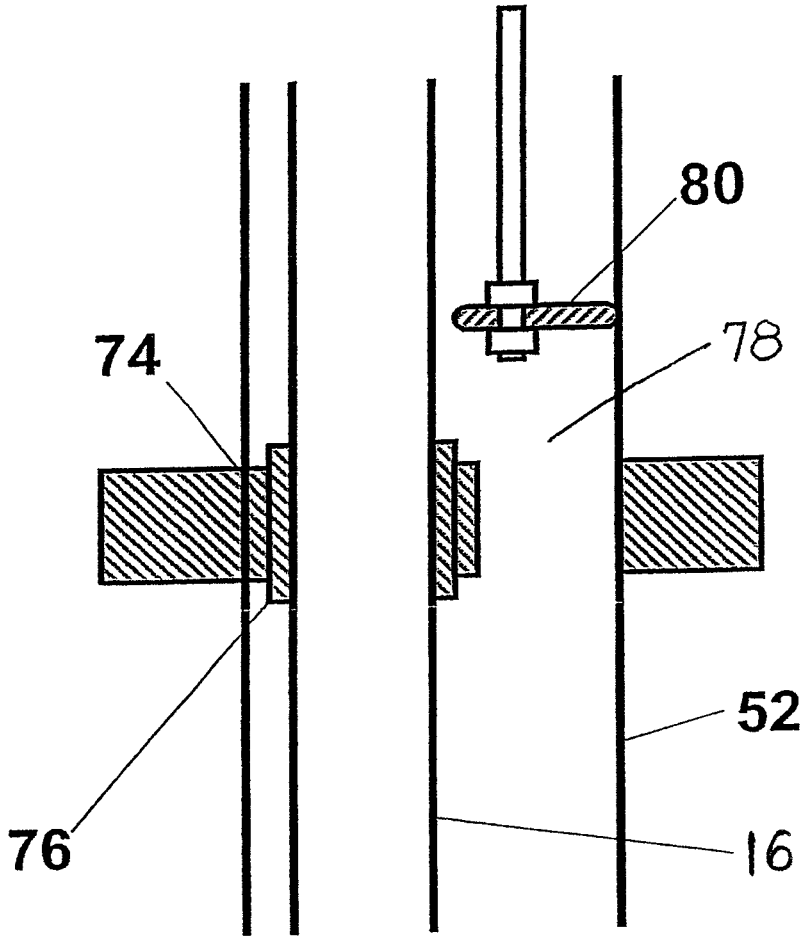
FIG. 6 shows a section through a further embodiment of the invention.

Referring now to FIG. 6, if necessary, in order to reduce the radiation load to a minimum, a radiation baffle may be placed above one or more of the holes 78, similar to baffles 20 shown in FIG. 1. Note however, that this will increase the pressure drop during quench and extra baffles can be provided in cases where minimum radiation load is required. Note that tube 16 is placed eccentrically within tube 52 so that hole 78 has the greatest hydraulic radius and also to provide the space for other services which are needed for the helium vessel or magnet, for example the helium replenishment, within the smallest overall diameter of service neck.

Figure 7:
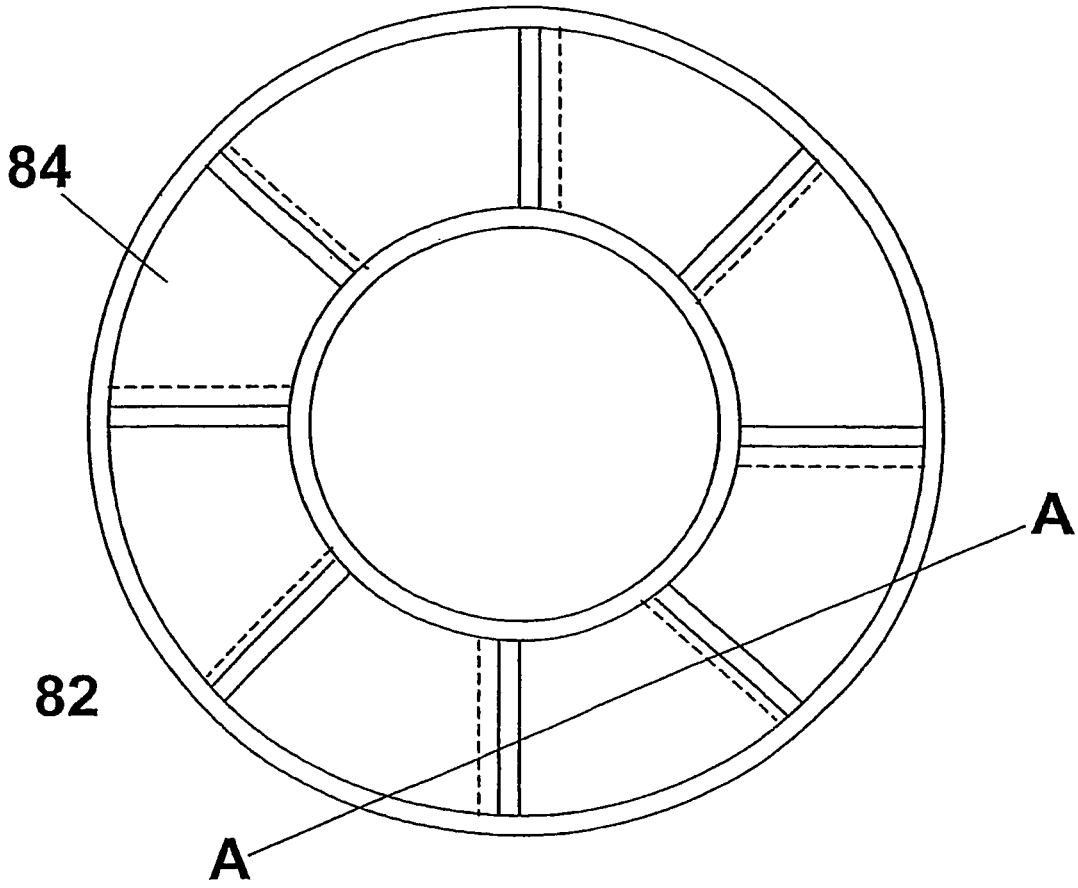
FIG. 7 shows a second type of collar.

FIG. 7 shows a variant of collar 74. The tubes 52 and 16 are now concentrically mounted. This collar 82 provides overlapping, angled web portions 84, supporting the central inner tube.

Figure 8:
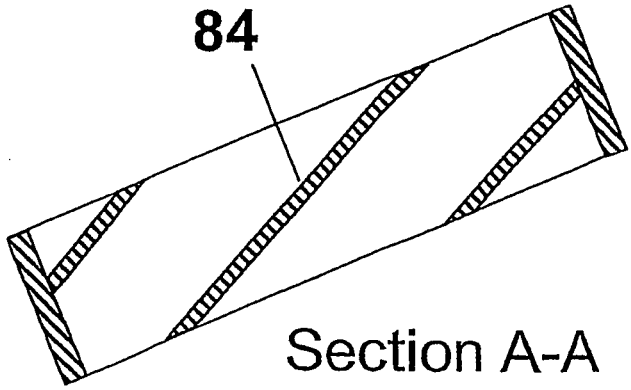
FIG. 8 shows a second section through the collar shown in FIG. 7.

FIG. 8 shows a secant-section A-A through the collar 82. This collar 82 provides for a low pressure drop path for quench gas whilst giving substantially complete radiation reflection characteristics.

Overall, low heat load is achieved in normal operation and during magnet energization due to the boil-off gas being in intimate contact with the surfaces of both tubes 52 and 16, and the collars 74, 82 provide intimate thermal contact with the tubes and the gas contained within the column.

Figure 9:
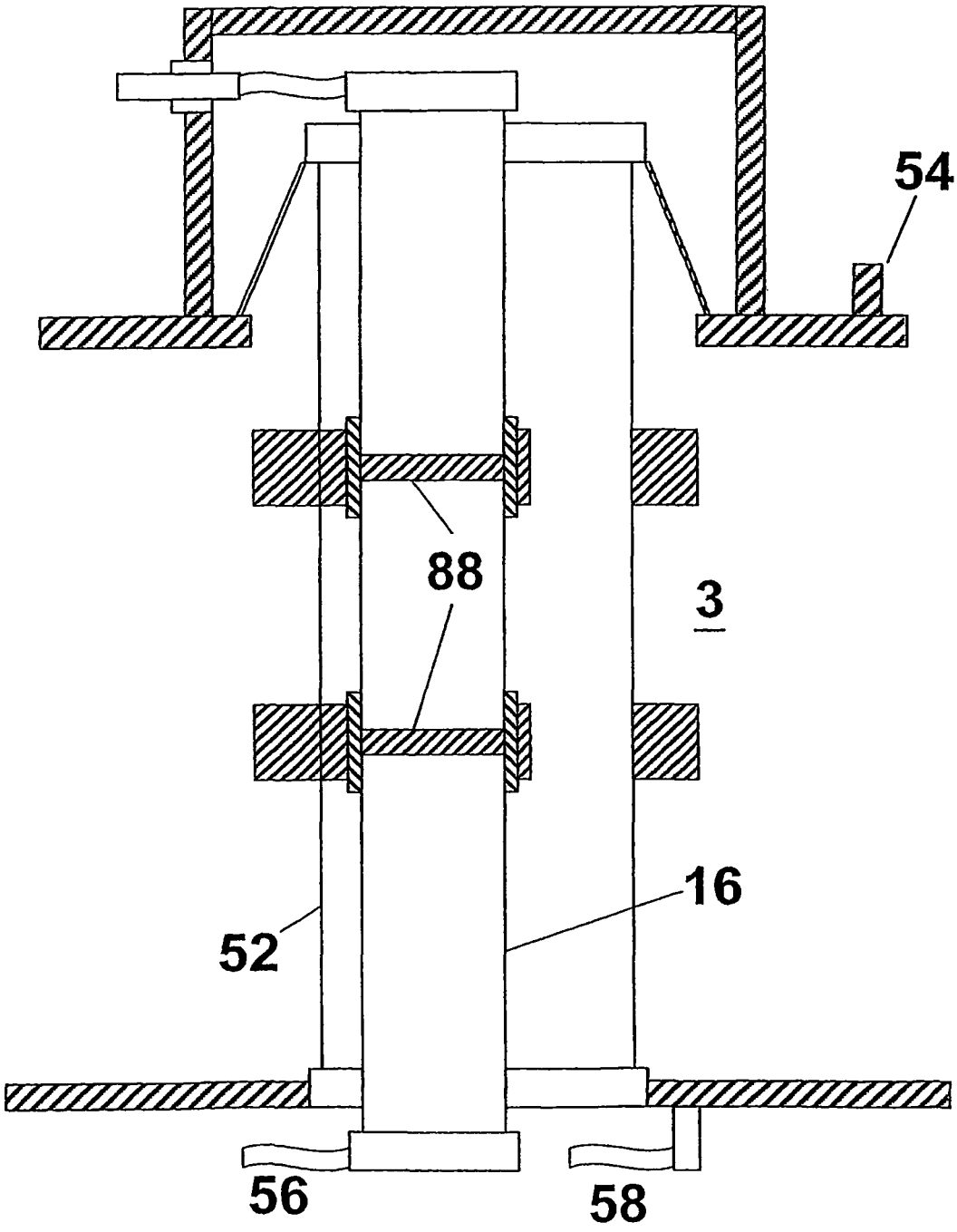
FIGS. 9 through 13 show further embodiments made in accordance with the invention.

The gas enclosed by tube 16 can be cooled more effectively by the provision of one or more conductive baffles 88 which are placed inside the tube in intimate thermal contact with the walls of the tube. Conveniently, the positions of baffles are placed on the inside of the tube forming the insulating ring 76, as shown in FIG. 9.

Figure 10:
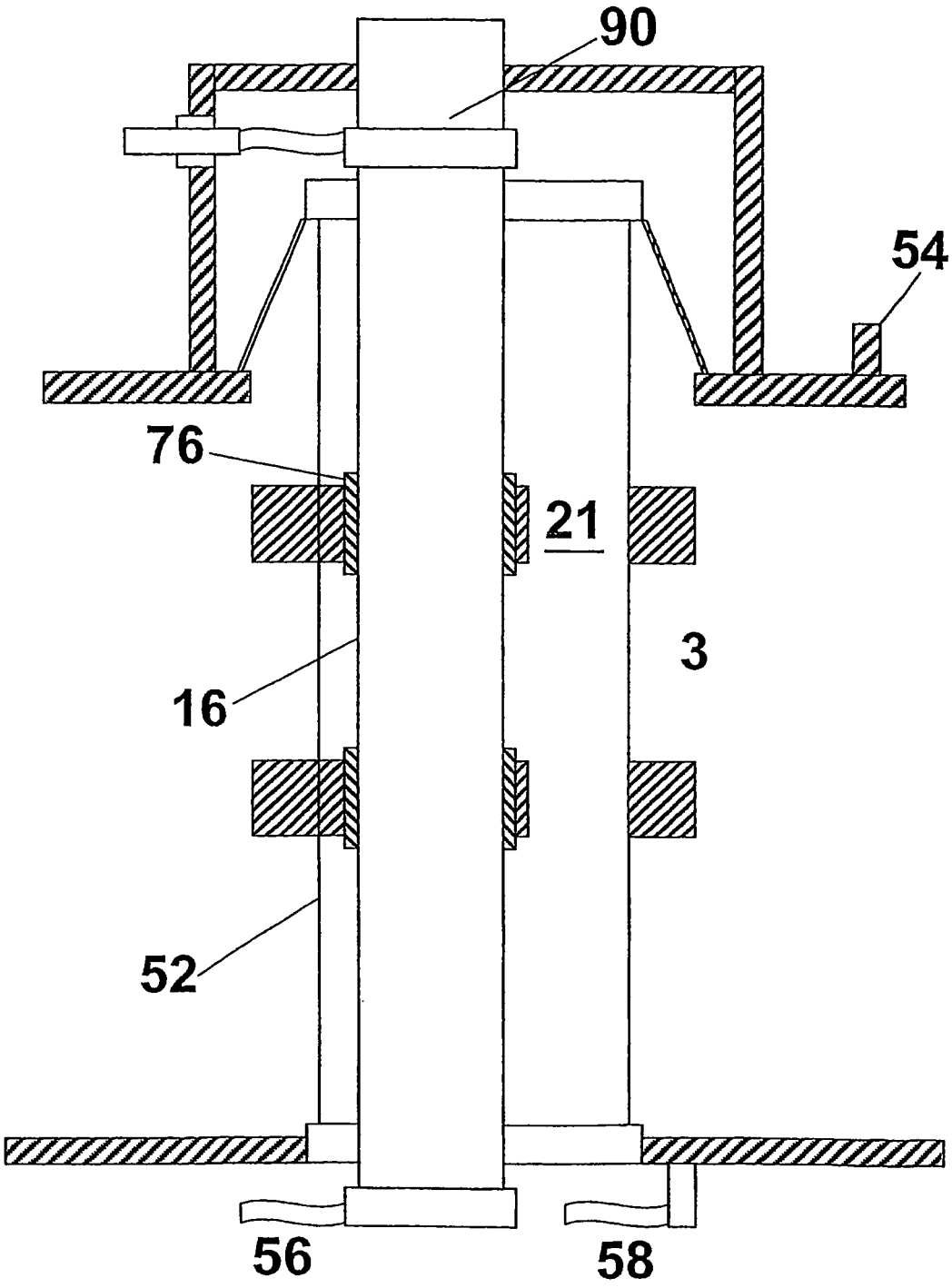

In an alternative embodiment, the inner tube 16 can be used as an emergency vent from the helium vessel in case the holes 21 should become blocked or are not large enough, as shown in FIG. 10. The portion of the inner tube at a high temperature is attached in a gas tight manner to an insulating tube 90 which projects through the gas tight turret to a safety valve or burst disc [not shown].

Figure 11:
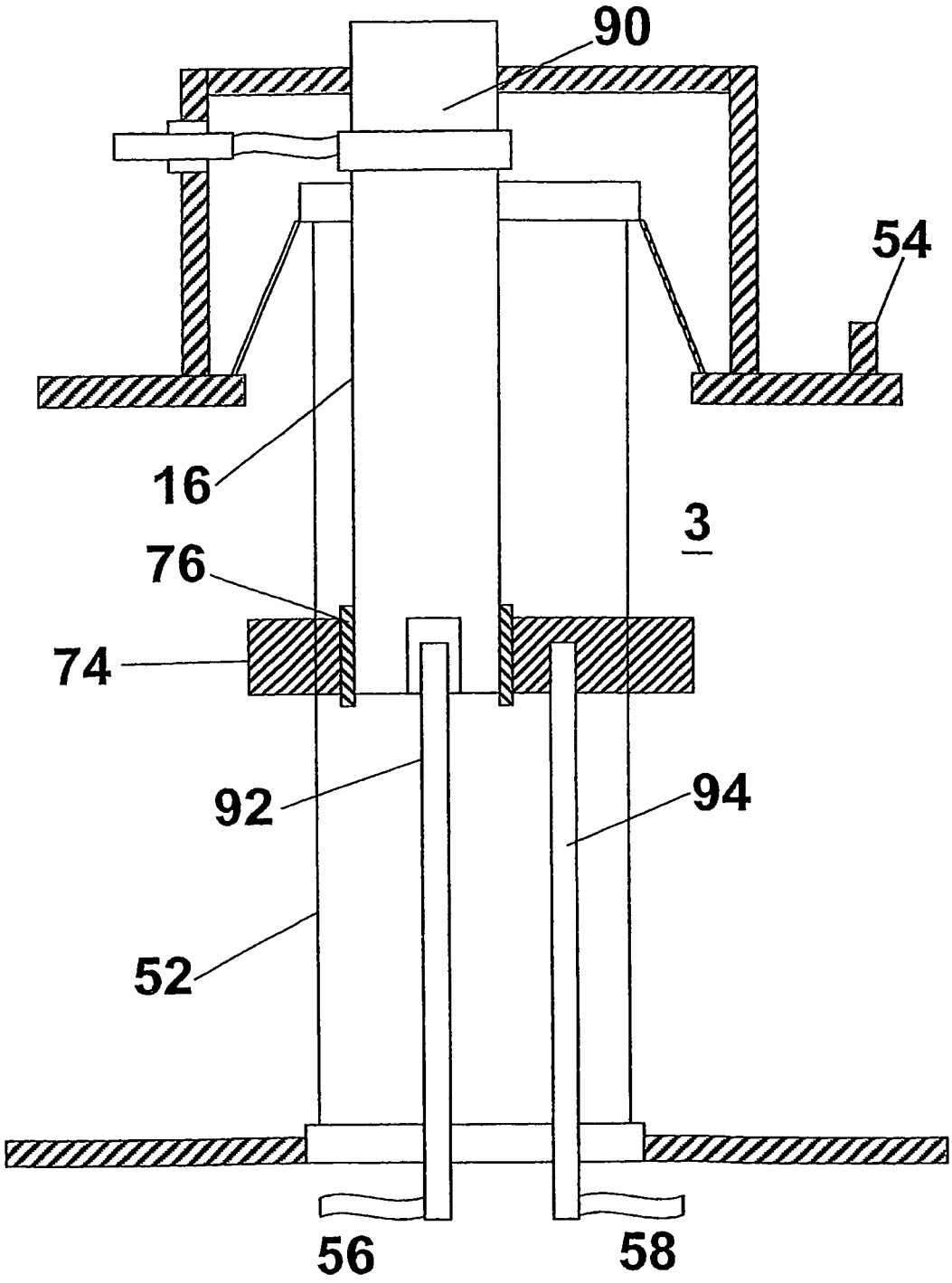

FIG. 11 shows a further variant of the design, in which the lower temperature part of the tube 16 has been replaced with a high temperature superconducting lead 92. This type of lead is well known, and may be used in low temperature regions, typically less than 70K, as a current lead having no resistive loss during energization of the magnet. In this example, the outer tube is shunted in the low temperature region by a high temperature superconducting lead 94 so as to reduce the load to the helium vessel during energization of the magnet. Lead 92 is electrically connected to the upper part of tube 16, and lead 94 is connected to the first current path comprising tube 52 via the thermal link collar. Flexible connections 56 and 58 electrically connect both leads 92 and 94 to the magnet.

Figure 12:
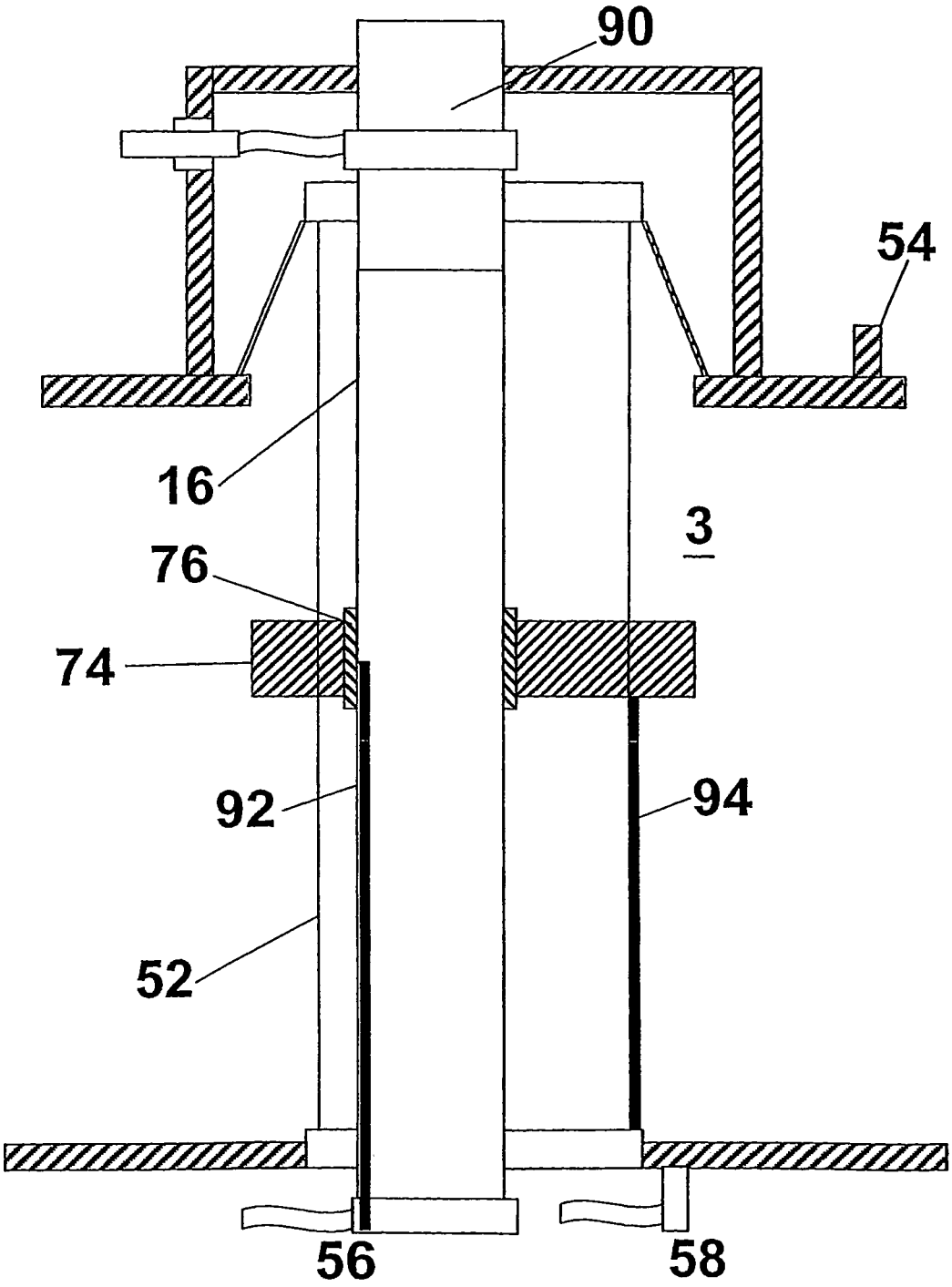

It is to be recognized that, although the high temperature superconducting leads 92 and 94 in FIG. 11 may conveniently be made as separate items, they may also be made as part of the low temperature ends of the current leads 16 and 52, as shown in FIG. 12, thereby providing no resistive loss in the lower parts of the leads 16 and 52 during magnet energization, but with the added safety that the leads 16 and 52 are also able to carry the current at non-superconducting temperatures.

It is to be noted that, in example FIG. 4, any electrically conducting path which connects the helium vessel to the vacuum vessel can be used to carry a part of the electric current in parallel with the outer tube 52 when energizing the magnet, and this can be taken into account when designing the first current path, so that the dimensions of thermal tube 52 can be reduced proportionately. Similarly, in an example shown in FIG. 11, any electrically conducting path which connects the thermal collar 74 to the outer vacuum vessel can be used to carry a part of the electric current in parallel with the upper section of the outer tube 52 when energizing the magnet, and this can be taken into account when designing the upper section of lead 52, so that the dimensions of the upper section can be reduced proportionately. This can be used to reduce the cross sectional area of tube 52 with a corresponding reduction in heat load to the helium vessel and heat sink.

Figure 13:
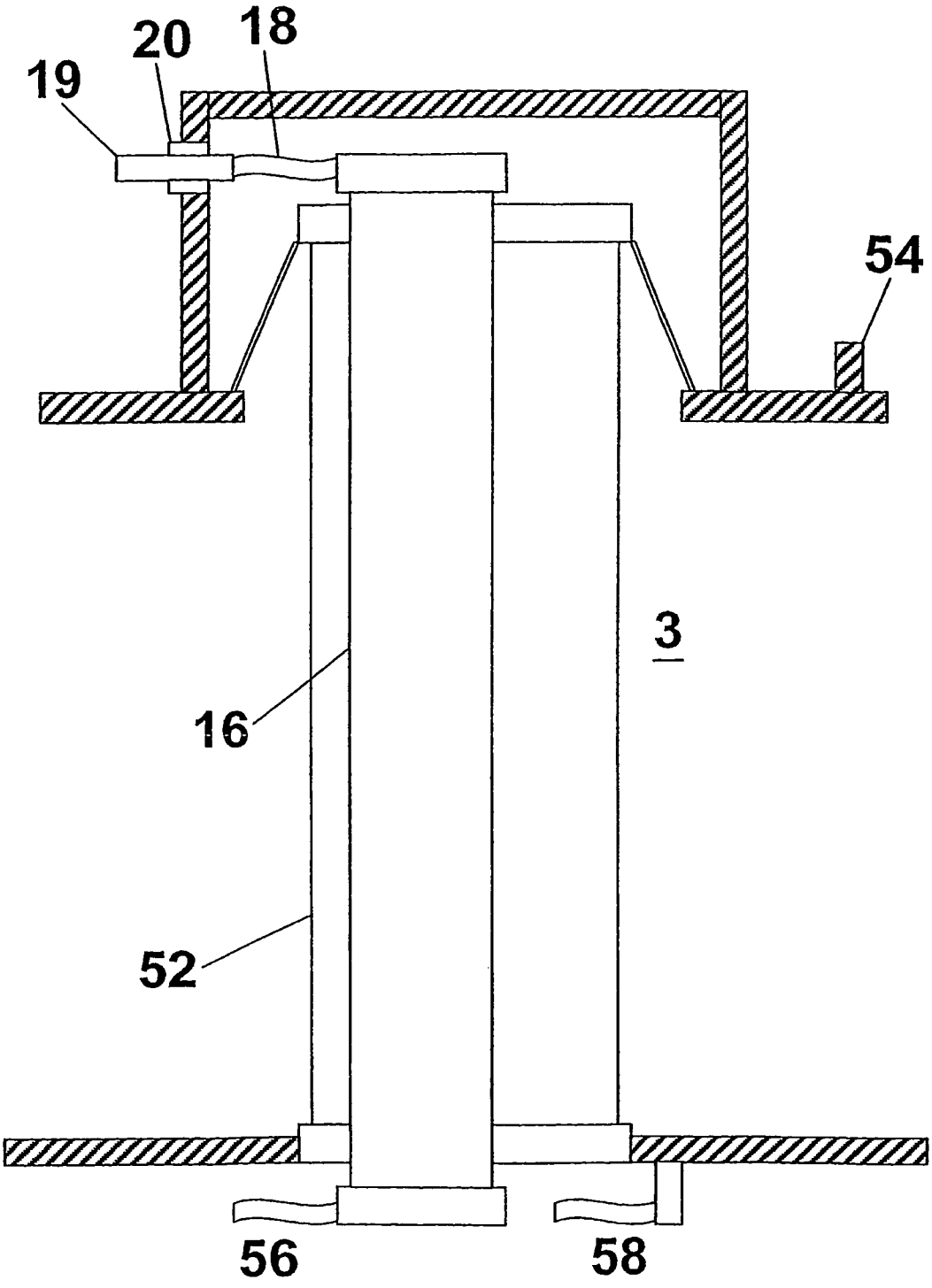

FIG. 13 shows an assembly with no shield, where the current lead is not intercepted at all. This can be used in a liquid nitrogen cryostat, and the electrical device operating inside the liquid can be e.g. a high temperature superconductor (HTS) coil, an HTS transformer, an HTS fault current limiter, cold electronics or any other device that requires the use of current leads.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A cryogenic assembly operable to support an electrical, electronic or magnetic device immersed in a cryogenic fluid said cryogenic assembly comprising:

a cryogenic fluid container; and a service neck tube having a bounding wall that encloses an interior thereof, and being operable to provide access from an ambient atmosphere to the cryogenic fluid container via said interior; wherein, the service neck tube comprises at least one positive and one negative current lead, which positive and negative current leads form respective distinct current paths that extend from an ambient temperature end of the service neck tube to a cryogenically cooled end thereof, and are electrically insulated from each other;

said bounding wall of the service neck tube itself forms a first one of said positive and negative current leads;

the second one of said positive and negative current leads is provided in the form of a conductor that is disposed within the bounding wall of the service neck tube; and a space between the bounding wall of the service neck tube and the second one of the positive and negative current leads forms a gas flow path from said cryogenic fluid container to an ambient environment, for venting evaporated cryogenic fluid from said cryogenic fluid container.

2. The cryogenic assembly according to claim 1, wherein the service neck tube comprises one of a single, a dual and a zero cooling stage neck.

3. The cryogenic assembly according to claim 1, wherein the assembly comprises part of a magnetic resonance imaging (MRI) assembly.

4. The cryogenic assembly according to claim 1, wherein the at least one positive and one negative current lead are arranged as tubes in a concentric or eccentric arrangement.

5. The cryogenic assembly according to claim 1, wherein the at least one positive and one negative current lead are arranged as tubes, and the tubes are provided with radiation baffles.

6. The cryogenic assembly according to claim 1, wherein a central current lead provides a secondary exhaust path.

7. The cryogenic assembly according to claim 1, wherein the at least one positive and one negative current lead and the service neck are thermally intercepted whereby to provide cooling stages that can be cryo-cooled.

8. The cryogenic assembly according to claim 1, with a high temperature superconductor current lead in a low temperature part.

9. The cryogenic assembly according to claim 1, wherein access to any low temperature apparatus requiring high current with low heat-in-leak, is fabricated from a thin walled metal such as stainless steel or titanium or brass or phosphor bronze.

10. A cryogenic assembly for supporting an electrical, electronic or magnetic device in a cryogenic fluid, said cryogenic assembly comprising:

a cryogenic fluid container having at least one tube that is operable to provide access from an ambient atmosphere to the cryogenic fluid container; wherein, said at least one tube comprises first and second current leads for supplying an electric current to said device;

the first one of said current leads is constituted by an outer wall of said at least one tube;

the second one of said current leads is electrically isolated from the first, and is disposed within said outer wall of said at least one tube; and a space between said outer wall of said at least one tube and said second one of said current leads forms a gas flow path from said cryogenic fluid container to an ambient environment, for venting evaporated cryogenic fluid from said cryogenic fluid container.

11. A cryogenic assembly for supporting an electrical, electronic or magnetic device in a cryogenic fluid, said cryogenic assembly comprising:

a cryogenic fluid container;

at least one tube that is operable to provide access to an interior of said cryogenic fluid container; and at least two electrical leads which are insulated from each other, for supplying electricity to said electrical, electronic or magnetic device in said cryogenic fluid container; wherein, an outer wall of said at least one tube forms a first one of said at least two electrical leads;

the other of said at least two electrical leads is disposed within said at least one tube and is electrically insulated therefrom; and a space between said outer wall of said at least one tube and the other of said at least two electrical leads forms a gas flow path from said cryogenic fluid container to an ambient environment, for venting evaporated cryogenic fluid from cryogenic fluid container.

* * * * *